US006772818B2

(12) United States Patent
Whitley et al.

(10) Patent No.: US 6,772,818 B2
(45) Date of Patent: Aug. 10, 2004

(54) INSULATED SECTIONAL DOOR PANEL

(75) Inventors: L. Blake Whitley, Arlington, TX (US); LeRoy G. Krupke, Carrollton, TX (US); Henri M. Friloux, Plano, TX (US); J. Wendall Compton, Roanoke, TX (US); James L. Grisham, Denison, TX (US)

(73) Assignee: Overhead Door Corporation, Dallas, TX (US)

( * ) Notice: Subject to any disclaimer, the term of this patent is extended or adjusted under 35 U.S.C. 154(b) by 0 days.

(21) Appl. No.: 10/308,301

(22) Filed: Dec. 3, 2002

(65) Prior Publication Data

US 2004/0103998 A1 Jun. 3, 2004

(51) Int. Cl.[7] ..... E06B 3/12
(52) U.S. Cl. ..... 160/236; 52/309.9
(58) Field of Search ..... 160/201, 236, 160/40; 52/309.9, 309.8, 784.15, 794.1

(56) References Cited

U.S. PATENT DOCUMENTS

| | | | | |
|---|---|---|---|---|
| 4,685,266 A | | 8/1987 | Mullet | |
| 4,779,325 A | | 10/1988 | Mullet | |
| 4,995,441 A | | 2/1991 | Leist et al. | |
| 5,016,700 A | * | 5/1991 | Wegner et al. | 160/232 |
| 5,125,155 A | | 6/1992 | Kyle et al. | |
| 5,177,868 A | | 1/1993 | Kyle et al. | |
| 5,435,108 A | | 7/1995 | Overholt et al. | |
| 5,445,208 A | | 8/1995 | Shaner et al. | |
| 5,509,457 A | | 4/1996 | Jella | |
| 5,562,141 A | | 10/1996 | Mullet et al. | |
| 5,709,259 A | | 1/1998 | Lewis et al. | |
| 5,787,677 A | | 8/1998 | Bolich et al. | |
| 5,921,307 A | | 7/1999 | Ford et al. | |
| 6,006,817 A | | 12/1999 | Stone et al. | |
| 6,024,908 A | | 2/2000 | Koncelik | |
| 6,076,590 A | | 6/2000 | Ford et al. | |
| 6,148,896 A | | 11/2000 | Pinto et al. | |
| 6,276,428 B1 | * | 8/2001 | Pettersson et al. | 160/201 |
| 6,330,901 B1 | | 12/2001 | Friesen et al. | |
| 6,381,917 B1 | * | 5/2002 | Thielow et al. | 52/784.1 |

* cited by examiner

*Primary Examiner*—Blair M. Johnson
(74) *Attorney, Agent, or Firm*—Gardere Wynne Sewell LLP

(57) ABSTRACT

A sectional garage door panel includes a skin part formed of a rolled metal sheet forming an outer wall and opposed top and bottom edges which may form a pinch resistant joint when adjacent panels are interconnected. Elongated prefabricated insulation parts are inserted in cavities formed by the top and bottom edges and a generally rectangular planar insulation part is insertable in a cavity formed between the top and bottom edges and between the first mentioned insulation parts. Channel shaped brackets are insertable in cavities formed by the top and bottom edges for reinforcing the skin part at a point of attachment of end stiles and hinge parts. A metal backer sheet forms an inner wall to protect the insulation parts. The brackets and one or more of the insulation parts may be secured to the skin part by an adhesive.

19 Claims, 4 Drawing Sheets

INSULATED SECTIONAL DOOR PANEL

BACKGROUND OF THE INVENTION

In the art of sectional doors, such as residential and commercial garage doors, there has been a continuing need to improve the construction of the respective door panels. Sectional door panels are commonly formed of rolled or extruded metal or plastic "skins" to which reinforcing members, hinges and insulation are attached or applied to form the finished door panel. Heretofore, for example, sectional door panels requiring insulation to be applied thereto have been formed by dispensing a quantity of a foamed-in-place polymer into a cavity formed by the rolled or extruded metal or plastic skin. This process may be difficult to control properly to fill all of the void spaces formed by the outer skin of the panel, particularly wherein the top and bottom edges of the panel are configured to provide a pinch resistant edge profile. Moreover, foamed-in-place insulation material may not provide sufficient stiffness or crush resistance for the insulation layer or the panel per se.

Even though reinforced sectional door panels have been previously known there has been a need to provide reinforcing members which are disposed only at critical locations, such as adjacent the points of attachment of other reinforcing members and/or panel hinges, for example. There has further been a need to provide a sectional door panel which includes a proper layer of insulation covering all of the panel void spaces, essentially, together with a skin member covering the insulation layer to minimize damage and deterioration of same.

Still further, there has been a need to provide sectional door panels with pinch resistant edge profiles with an anti-scuffing or anti-scraping coating at critical positions which otherwise would tend to scratch or disfigure the cooperating edge of an adjacent panel.

It is to provide the desiderata mentioned above and overcome deficiencies in prior art sectional door panels of the general type described herein that the present invention has been developed.

SUMMARY OF THE INVENTION

The present invention provides an improved sectional door panel and a method of assembly, particularly a sectional door panel which is thermally insulated.

In accordance with one important aspect of the present invention, a sectional door panel is provided which is characterized by a rolled or extruded metal or plastic outer skin part which forms an outer wall of the panel and top and bottom edges, is reinforced by opposed end stiles and forms a relatively shallow pan like cavity which may be substantially filled with multiple insulation parts which are insertable in spaces defined by the top and bottom panel edges and by space therebetween. The insulation parts may be protected by a reinforcing inner skin or backer part which may be secured to the panel by an adhesive and/or mechanical fasteners.

In accordance with another aspect of the invention a sectional door panel is provided with preinstalled reinforcing brackets for reinforcing the attachment points of panel reinforcing members and/or hinge members for interconnecting the panel with adjacent panels.

The present invention still further provides an improved sectional door panel and method assembly which is advantageous for the production of large quantities of door panels of various selected lengths and widths.

Those skilled in the art will further appreciate the advantages and superior features of the invention upon reading the detailed description which follows in conjunction with the drawings.

DETAILED DESCRIPTION OF A PREFERRED EMBODIMENT

Figure 1:
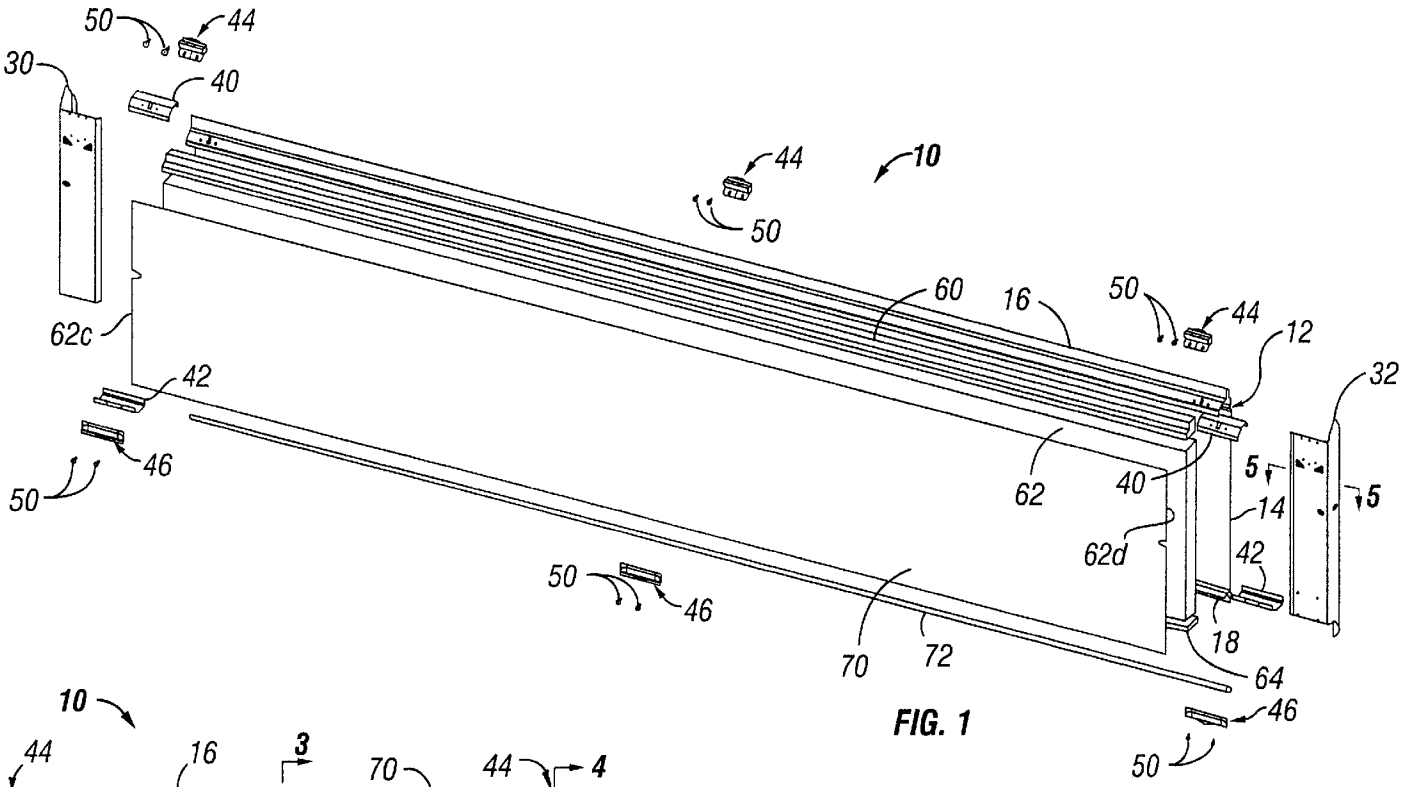
FIG. 1 is an exploded perspective view of a sectional door panel in accordance with the present invention.

In the description which follows like parts are marked throughout the specification and drawing with the same reference numerals, respectively. The drawing figures are not necessarily to scale and certain features may be shown in schematic or generalized form in the interest of clarity and conciseness.

Figure 2:
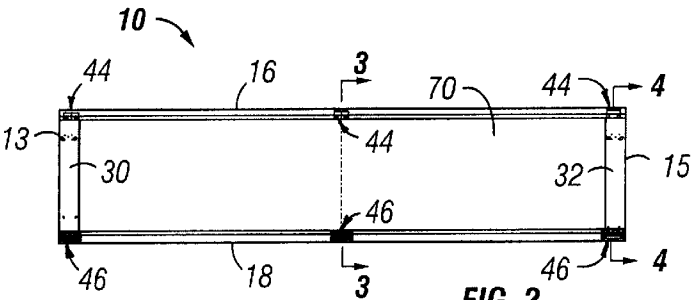
FIG. 2 is an elevation view of the inner side of the panel, assembled.

Referring to FIGS. 1 and 2, there is illustrated a sectional door panel in accordance with the invention and generally designed by the numeral 10. The door panel 10 is preferably formed of a member 12 which may comprise a rolled or extruded metal or plastic skin part forming an outer, generally planar wall 14, see FIG. 3 also, and top and bottom edges 16 and 18. Top edge 16, FIG. 3, includes a convex curved portion 16a extending substantially between front wall 14 and a vertically extending offset wall portion 16*b* which is contiguous with a generally horizontal shelf portion 20. Shelf portion 20 extends to an inclined wall portion 22 which is contiguous with an upper inner wall 24 generally parallel to outer wall 14. The configuration of the top edge 16 is also disclosed in detail in U.S. Pat. No. 6,328,091 issued Dec. 11, 2001 to L. Blake Whitley and assigned to the assignee of the present invention. The entire disclosures of U.S. Pat. No. 6,328,091 and co-pending U.S. patent application Ser. No. 09/910,992 filed Jul. 23, 2001 by L. Blake Whitley, et al, also assigned to the assignee of present invention, are incorporated herein by reference.

Figure 3:
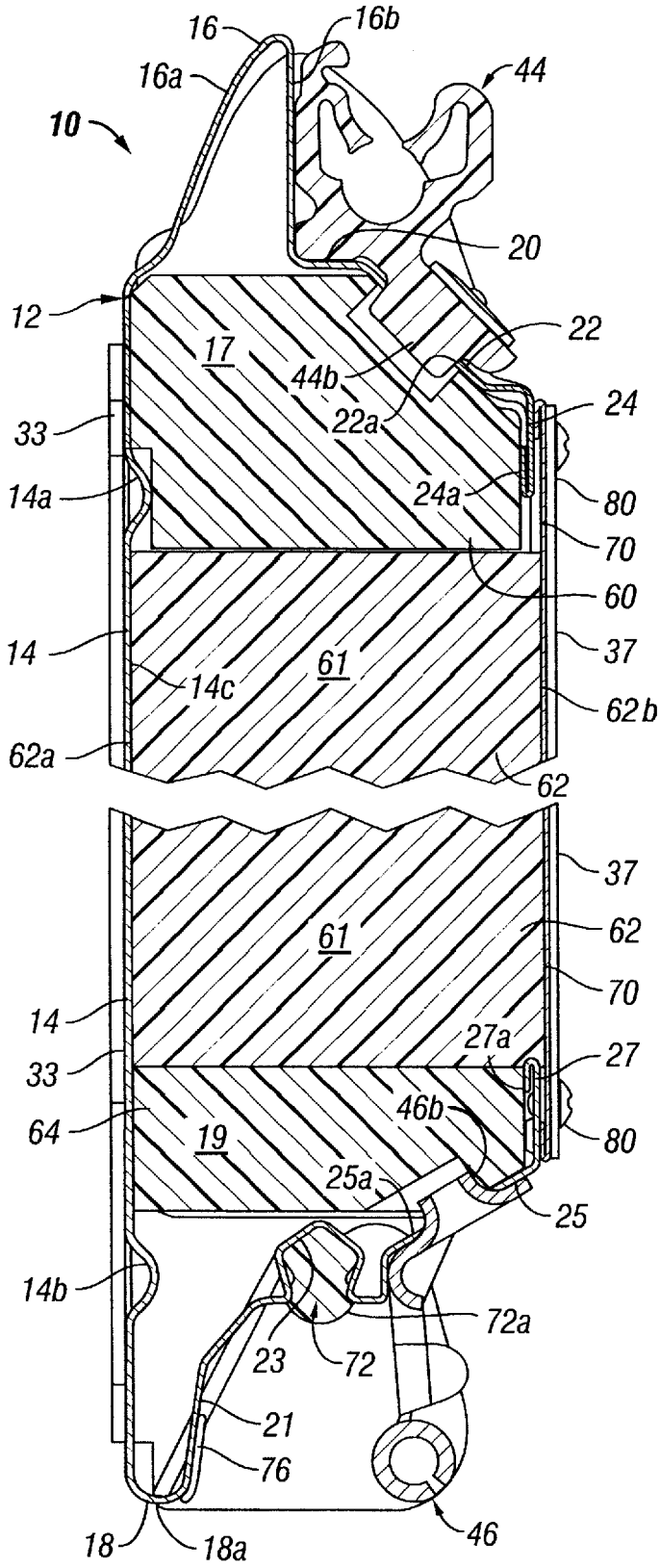
FIG. 3 is a detail section view taken from the line 3—3 of FIG. 2.
Figure 4:
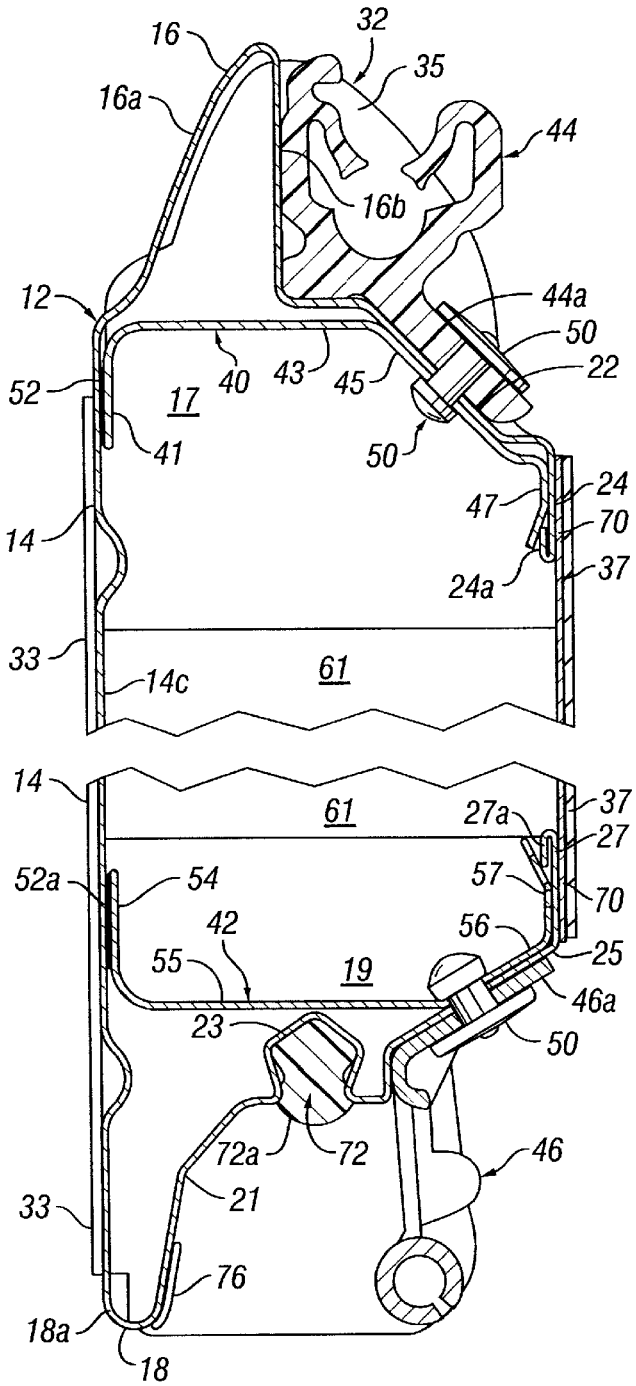
FIG. 4 is a detail section view taken generally along the line 4—4 of FIG. 2 with the insulation parts omitted.

Panel bottom edge 18 includes a convex curved nose part 18*a* and a generally concave part 21, FIG. 3 or 4, which is coextensive with an elongated groove or recess 23, an inclined inner wall portion 25 and a relatively short lower inner wall 27 generally parallel to outer wall 14 and substantially coplanar with upper inner wall 24. Inner walls 24 and 27 preferably have rolled reinforced inturned flange parts 24*a* and 27*a*, respectively. Outer wall 14 may be provided with generally coextensive elongated reinforcement recesses 14*a* and 14*b*, FIG. 3. Skin part 12 may be formed by rolled steel of a selected thickness, such as in a range of about twenty four ga or twenty five ga. Alternatively, skin part 12 may be formed of extruded metal or plastic.

Figure 5:
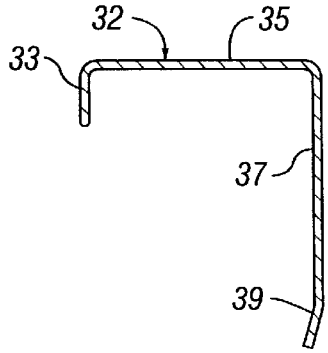
FIG. 5 is a detail section view taken from line 5—5 of FIG. 1.

Referring further to FIG. 1, the panel 10 is also characterized by opposed end stiles 30 and 32 which are substantially identical mirror image parts. Referring briefly to FIG. 5, by way of example, end stile 32 comprises, generally, an elongated angle shaped part including a short outer flange 33, a web 35, extending normal thereto and an inner flange 37 normal to web 35 and which is creased and bent slightly at its distal end, as indicated at 39. Distal flange end 39 and a counterpart flange portion 31, FIG. 6, of end stile 30 are formed so as to fit tightly against an inner wall or backer part to be described further herein. End stile 30 is substantially identical in cross sectional configuration but of an opposite "hand" or comprising a mirror image of end stile 32. End stiles 30 and 32 may also be formed of rolled or otherwise formed steel having a thickness similar to the thickness of the skin part 12.

Referring again to FIG. 1, the panel 10 is still further characterized by plural formed metal reinforcing brackets 40 and 42 which are somewhat channel shaped and are adapted to nest within respective cavities 17 and 19, FIG. 4, formed generally by the profiles of the upper and lower edges 16 and 18, and in positions to provide additional support for the end stiles 30 and 32 and respective panel hinge members 44 and 46, which may be generally of the configuration of the hinge members disclosed in U.S. Pat. No. 6,328,091, respectively. Depending on the width of a panel 10, hinge members 44 and 46 may be secured to the upper and lower edges of the panel at spaced apart points generally as indicated in FIGS. 1 and 2, that is, with hinge members 44 and 46 positioned adjacent opposite side edges 13 and 15 of panel 10, see FIG. 2, and in a position generally intermediate the opposite side edge portions, as indicated in FIGS. 1 and 2.

As shown in FIG. 4, each reinforcing bracket 40 includes a first flange 41, an intermediate web 43, an inclined flange 45 and a further flange part 46 generally parallel to flange 41. Bracket 40 thus provides reinforcement for the skin part 12 at the point of attachment of a hinge member 44 to the skin part and also strengthens the panel in the area where the opposed end stiles 30 and 32 are secured to the skin part. As shown in FIG. 4, for example, hinge part 44 includes a support flange 44*a* which is adapted to be contiguous with inclined wall part 22 and secured thereto by suitable fasteners, such as blind rivets 50. Blind rivets 50 may be of a conventional type and, particularly, of a type sold under the trademark MULTIGRIP. Plural rivets 50 may be used to secure a hinge member 44 to the continuous inclined wall part 22 which extends across the skin part 12 between the opposite side edges 13 and 15 of panel 10.

As further shown in FIG. 4, support bracket 40 may be initially held in the position shown with respect to the skin part 12, and further held to reinforce the skin part, by a bead of adhesive 52 between flange 41 and outer wall 14. Adhesive bead 52 is preferably coextensive with the length of the bracket 40 and which is substantially also the width of flange 37 of the exemplary end stile 32. Once the hinge parts 44 have been assembled to the panel 10 by the fasteners 50, the bracket 40 is also completely secured in its working position, as shown in FIG. 4, to reinforce the panel 10 at the position of the hinge parts adjacent the opposite side edges 13 and 15, respectively.

Referring further to FIG. 4, support brackets 42 are each characterized by an upturned flange 54, a web 55, an inclined web portion 56 and an upturned flange 57; spaced from and substantially coextensive with flange 54 to form a somewhat channel shaped member. Support bracket 42 is located initially in its working position shown in FIG. 4 by a bead of adhesive 52*a* between flange 54 and outer wall 14 as shown in the drawing figure. Adhesive bead 52*a* is similar to adhesive bead 52. Brackets 42 are placed adjacent opposite side edges 13 and 15 of panel 10 to reinforce the skin part 12 and the end stiles 30 and 32, generally at the point of attachment of hinge members 46, respectively. As shown in FIG. 4, hinge members 46 are each, characterized by a mounting flange 46*a* including a suitable fastener receiving bore which is alignable with cooperating fastener receiving bores formed in inclined wall part 25 and flange part 56 of bracket 42 for receiving a blind rivet type fastener 50 in the same manner that the hinge part 44, inclined wall part 22 and flange part 45 are operable to receive fasteners 50 for securing the hinge part 44 to the panel 10 at the upper edge 16.

As shown in FIG. 3, hinge parts 44 and 46 include respective locating bosses 44*b* and 46*b*, as described in co-pending patent application Ser. No. 09/910,992, for precisely locating the respective hinge parts 44 and 46 with respect to the panel 10. In this respect the inclined wall parts 22 and 25 are provided with suitable locating bores or recesses 22*a* and 25*a*, respectively, for receiving the boss portions 44*b* and 46*b*, as illustrated in FIG. 3, and as described in co-pending patent application Ser. No. 09/910,992.

Referring again to FIG. 1, the panel 10 is further characterized by pre-formed elongated insulation members or parts 60, 62 and 64, respectively, which are dimensioned to fit within cavities formed by the skin part 12. For example, as shown in FIG. 3, insulation rail part 60 has a cross sectional shape adapted to be positioned within a substantial portion of the cavity 17 between outer wall 14 and inner wall part 24, and at least a portion of the area of cavity 17 defined by the upper edge 16 to reinforce the skin part 12 in that area and to also provide acoustic and thermal insulation. In like manner, elongated insulation rail part 64 is dimensioned, as shown in FIG. 3, to nest within at least part of cavity 19 delimited by outer wall 14 and inner wall part 27 to occupy a portion of the cavity defined by the lower edge 18 of the panel 10.

When insulation rail parts 60 and 64 have been positioned, as shown in FIG. 3, generally rectangular planar insulation part 62 is interposed the insulation parts 60 and 64, as shown, to substantially fill a cavity or space 61 formed by the substantially pan shaped skin part 12 between cavities 17 and 19 and between opposite panel side edges 13 and 15. At least insulation part 62 may be secured in its working position shown in FIG. 3 by coating a surface 62*a* of insulation part 62 with a suitable hot melt adhesive. In this way insulation part 62 may be permanently adhered to the panel 10 at the inner surface of wall part 14.

Still further, opposite and parallel surface 62*b*of insulation part 62 may also have a coating of adhesive applied thereto for securing an inner wall sheet or skin part 70 thereto as shown in FIG. 3. Inner wall skin part or backer 70 may be formed of sheet steel, preferably twenty-eight ga. to twenty-nine ga., or another material of substantial strength to protect the insulation part 62 and to further strengthen the door panel 10. Opposite side edges 62*c* and 62*d* of skin or backer part 70 are disposed between insulation part 62 and the flanges of the respective end stiles 30 and 32 including, for example, the flanges 37, 39 of end stile 32. Backer or inner skin part 70 is of about the same length as outer skin 12 and is dimensioned to substantially overlie inner wall parts 24 and 27. The insulation parts 60, 62 and 64 are preferably formed of somewhat rigid polymer foam, such as expanded polystyrene (EPS), for example, and having a density of about 1.0 to 2.0 lb/ft$^3$.

Still further, as shown in FIGS. 1, 3 and 4, the panel 10 is preferably formed with an elongated elastomer seal strip 72 which is adapted to be disposed in groove or recess 23 and extending between side edges 13 and 15. Seal strip 72 is preferably formed of polyethylene foam extrusion and is dimensioned to be a force fit within the groove 23 so that it retains itself therein during operation of a door which includes plural interconnected panels 10, such a door of the type, generally, as described in U.S. Pat. No. 6,328,091 and co-pending patent application Ser. No. 09/910,992, which are incorporated herein by reference. The seal strip 72 is characterized by a convex contact portion 72*a*, FIGS. 3 and 4, may also be modified to have a hollow interior and be formed of extruded or molded polyvinyl chloride.

Referring further to FIGS. 3 and 4, the generally concave part 21 of lower edge 18 is preferably provided with at least one elongated wear or anti-scuff strip 76 of a wear resistant material, such as polyurethane, which may be applied by spraying or brushing on the surface of the concave part 21, and having a thickness of about 0.004 to 0.010 inches. Wear strip 76 extends substantially entirely across the panel 10 between edges 13 and 15 and has a width of about 0.38 inches, by way of example. Wear strip 76 may be provided in an area extending from the lower convex nose part 18*a*, as shown in FIGS. 3 and 4, upwardly over at least a portion of the concave part 21 of lower edge 18 so that, when the panel 10 is connected to an adjacent panel, the concave part 21 will not rub forcibly against convex part 16*a* of the adjacent panel and scuff such convex part which would be deleterious to the aesthetic qualities of panel 10. Moreover, wear strip 76 also assists in providing a seal between concave part 21 and convex part 16*a*when adjacent panels 10 are in a door closed position, as described and shown in U.S. Pat. No. 6,328,091.

Figure 6:
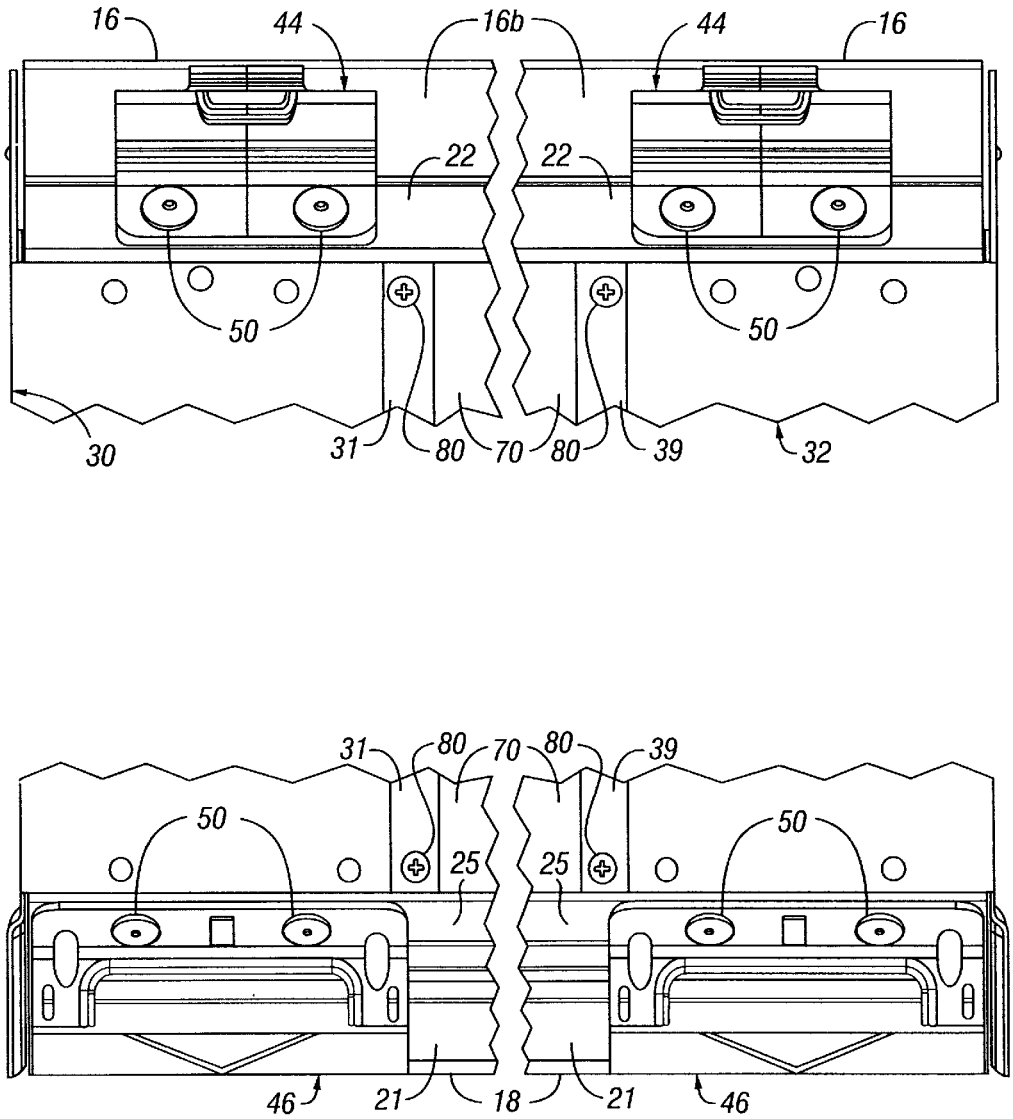
FIG. 6 is a fragmentary elevation of the panel taken from the same direction as the view of FIG. 2, but on a larger scale.

As shown in FIGS. 3 and 6, distal flange portion 39 of end stile 32 and a distal flange portion 31 of end stile 30 are adapted to receive threaded fasteners, such as self tapping screws 80, for securing the respective flange portions of the stiles 30 and 32 to the respective upper and lower inner wall parts 24 and 27 with backer part 70 disposed therebetween.

One advantage of the multipart insulation panel comprising the insulation rail parts 60 and 64 and the intermediate panel part 62 is that these parts may be preformed in predetermined lengths and, if necessary, cut to size for various lengths of door panels 10. Still further, the inconveniences associated with foamed-in-place polymer insulation in sectional door panels is eliminated. A preferred method of assembling a panel 10, comprises providing the parts illustrated in FIG. 1 and inserting the support brackets 40 and 42 in their respective working positions, as shown in FIG. 4, by applying a bead of adhesive 52 and 52*a* to the inside surface of outer wall 14 or to the flanges 41 and 54 of the respective brackets 40 and 42 and placing these brackets in their working positions shown in FIG. 4. After placement of the brackets 40 and 42 in their working positions, the insulation rail parts 60 and 64 may be positioned generally as shown in FIG. 3. Typically, a panel 10, during assembly, will be disposed on a horizontal surface with the wall part 14 in contact therewith. Once the insulation parts 60 and 64 are in place, a pre-formed insulation panel part 62 may be coated with adhesive on opposite surfaces 62*a* and 62*b* thereof and placed in engagement with the inner surface 14*c* of outer wall 14 in the position shown in FIG. 3, and substantially filling cavity 61. At this time backer or inner skin part 70 may be positioned for engagement with the surface 62*b* of insulation panel 62 and overlying the inner wall parts 24 and 27. Opposed end stiles 30 and 32 may then be placed in their working positions and secured to the backer 70 and the inner wall parts 24 and 27 with fasteners 80.

Following assembly of the panel 10 to the point indicated hereinabove, the hinge parts 44 and 46 may be assembled to the panel 10 using the locating features provided by the bosses 44*b* and 46*b* and in accordance with methodology, generally as described in U.S. patent application Ser. No. 09/910,992. The hinge parts 44 and 46 may then be secured in place by fasteners, such as the blind rivets 50, for example, or other suitable mechanical fasteners, if desired.

The door panel 10 may be constructed of conventional engineering materials used in the art of sectional doors and the like and including the materials noted herein. Except as noted herein, conventional manufacturing methods may be used to fabricate the panel 10 and its component parts. Although a preferred embodiment of the invention has been described in detail, those skilled in the art will recognize that various substitutions and modifications may be made without departing from the scope and spirit of the invention as set forth in the appended claims.

What is claimed is:

1. A sectional door panel comprising:

a generally planar outer wall;

opposed top and bottom longitudinal edges joined to said outer wall and spaced apart inner walls spaced from said outer wall and forming opposed spaced apart elongated cavities at said top and bottom edges, respectively, and a cavity disposed therebetween; and plural prefabricated insulation parts including a first elongated insulation part inserted in and extending across a major part of said cavity formed at said top edge, a second elongated insulation part inserted in and extending across a major part of said cavity formed at said bottom edge and a generally planar insulation part disposed between said first and second insulation parts and filling said cavity disposed between said cavities formed at said top and bottom edges, respectively, and operable to restrict movement of said first and second insulation parts into said cavity disposed between said cavities formed at said top and bottom edges, respectively.

2. The door panel set forth in claim 1 including:

opposed preformed end stile members secured to said inner walls by mechanical fasteners and closing opposite lateral side edges of said panel.

3. The door panel set forth in claim 1 including:

spaced apart reinforcing brackets configured to be inserted in said cavities formed at said top and bottom edges, respectively, for reinforcing said top and bottom edges of said panel.

4. The door panel set forth in claim 3 wherein:

said brackets are disposed for engaging hinge retaining fasteners for securing opposed hinge parts to said panel at said top and bottom edges, respectively.

5. The door panel set forth in claim 3 wherein;

said support brackets are retained in said cavities formed at said top and bottom edges by an adhesive, respectively, and connecting said support brackets to a surface of said outer wall.

6. The door panel set forth in claim 1 wherein:

said generally planar insulation part is secured to a surface of said outer wall by an adhesive.

7. The door panel set forth in claim 1 wherein:

said top edge includes a convex curved portion and said bottom edge includes a concave curved portion cooperable with a convex curved portion of an adjacent door panel when said panel is connected to said adjacent door panel, and at least one of said convex and concave curved portions includes a wear strip thereon for minimizing scuffing of the other of said convex and concave curved portions of said edges, respectively, on said adjacent door panel.

8. A sectional door panel comprising:

a rolled metal skin part forming a generally planar outer wall; opposed top and bottom longitudinal edges joined to said outer wall and spaced apart inner walls spaced from said outer wall and forming opposed spaced apart cavities at said top and bottom edges and a cavity disposed therebetween;

at least two prefabricated insulation parts insertable in said cavities at said top and bottom edges and at least part of said cavity formed therebetween;

spaced apart reinforcing brackets inserted in said cavities at said top and bottom edges and engaged with said outer wall and one of said inner walls, respectively, for reinforcing said top and bottom edges of said panel and for engaging hinge retaining fasteners for securing opposed hinge parts to said panel at said top and bottom edges, respectively; and opposed end stile members secured to said inner walls by mechanical fasteners and closing opposite lateral side edges of said panel.

9. The door panel set forth in claim 8 wherein:

said brackets are retained in said cavities by an adhesive, respectively, connecting said brackets to a surface of said outer wall.

10. The door panel set forth in claim 8 wherein:

at least one of said insulation parts is secured to a surface of said outer wall by an adhesive.

11. The door panel set forth in claim 8 wherein:

said top edge includes a convex curved portion and said bottom edge includes a concave curved portion cooperable with a convex curved portion of an adjacent door panel when said panel is connected to said adjacent door panel, and at least one of said convex and concave carved portions includes a wear strip thereon for minimizing scuffing of the other of said convex and concave portions of said edges, respectively, on said adjacent door panel.

12. A method of assembling an insulated door panel for a sectional door comprising the steps of:

providing a rolled metal outer skin part forming an outer wall, opposed top and bottom edges extending between opposite lateral side edges and spaced apart inner walls;

providing opposed end stile members engageable with said skin part to close said opposite lateral side edges of said panel, respectively;

inserting elongated, substantially rigid insulation parts in cavities formed by said top and bottom edges, respectively;

inserting a substantially planar and substantially rigid insulation part in a cavity formed between said top and bottom edges between said elongated insulation parts and operable to restrict movement of said elongated insulation parts into said cavity formed between said top and bottom edges from said cavities formed by said top and bottom edges, respectively; and closing opposite lateral side edges of said panel by attaching said end stile members to said skin part, respectively.

13. The method set forth in claim 12 including the step of:

securing said substantially planar insulation part to said skin part with an adhesive.

14. The method set forth in claim 12 including the step of:

securing a generally planar backer member to at least one of said end stiles and said inner walls to close said cavities with said insulation parts therein.

15. The method set forth in claim 12 including the step of:

applying an elongated wear strip to one of said edges to minimize scuffing the other of said edges of an adjacent panel.

16. A sectional door panel comprising:

a generally planar outer wall;

opposed top and bottom longitudinal edges joined to said outer wall and spaced apart inner walls spaced from said outer wall and forming opposed first and second spaced apart cavities at said top and bottom edges, and a third cavity disposed therebetween;

plural prefabricated insulation parts insertable in said cavities formed at said top and bottom edges and at least part of said cavity disposed therebetween, said insulation parts including a first elongated insulation part insertable in said first cavity, a second elongated insulation part insertable in said second cavity and a generally planar insulation part disposed between said first and second insulation parts and filling said third cavity to restrict movement of said first and second insulation parts into said third cavity and secured to a surface of said outer wall by an adhesive; and a backer engageable with said inner walls, respectively, for closing said third cavity, said backer being secured to part of said door panel by one of an adhesive and mechanical fasteners, respectively.

17. A sectional door panel comprising:

a rolled metal skin part forming a generally planar outer wall, opposed top and bottom longitudinal edges to said outer wall and spaced apart inner walls spaced from said outer wall and forming opposed spaced apart cavities at said top and bottom edges and a cavity disposed therebetween;

prefabricated insulation parts insertable in said cavities formed at said top and bottom edges, respectively, and an insulation part insertable in at least part of said cavity formed therebetween to restrict movement of said insulation parts out of said cavities formed at said top and bottom edges into said cavity formed therebetween;

at least one of said insulation parts is secured to a surface of said outer wall by an adhesive;

a backer engageable with said inner walls, respectively, for closing said cavity formed between said spaced apart cavities, said backer being secured to parts of said door panel by one of an adhesive and mechanical fasteners, respectively; and opposed end stile members secured to said inner walls by mechanical fasteners and closing opposite lateral side edges of said panel.

18. A method of assembling an insulated door panel for a sectional door comprising the steps of:

providing a rolled metal outer skin part forming an outer wall, opposed top and bottom edges and spaced apart inner walls;

providing opposed end stile members engageable with said skin part to close opposite lateral side edges of said panel;

placing reinforcing brackets within respective cavities formed by said top and bottom edges and into engagement with said outer wall and respective ones of said inner walls, respectively, and securing said brackets, respectively, to one of said outer wall and said inner walls;

inserting elongated, substantially rigid insulation parts in said cavities formed by said top and bottom edges, respectively, after placement of said brackets in said cavities formed by said top and bottom edges;

inserting a substantially rigid insulation part in a cavity formed between said top and bottom edges; and closing opposite lateral side edges of said panel by attaching said end stile members to said skin part, respectively.

19. The method set forth in claim 18 wherein:

said brackets are secured to said one of said outer wall and said inner walls by an adhesive.

* * * * *